US005598190A

United States Patent [19]

Yoshida

[11] Patent Number: 5,598,190

[45] Date of Patent: Jan. 28, 1997

[54] RECORDING APPARATUS WITH STANDBY CONTROL FOR THERMAL HEAD

[75] Inventor: Takehiro Yoshida, Tokyo, Japan

[73] Assignee: Canon Kabushiki Kaisha, Tokyo, Japan

[21] Appl. No.: 70,282

[22] Filed: Jun. 2, 1993

[30] Foreign Application Priority Data

Jun. 12, 1992 [JP] Japan ..... 4-153347

[51] Int. Cl.[6] ..... B41J 29/38; B41J 2/155

[52] U.S. Cl. ..... 347/13; 347/17; 347/42

[58] Field of Search ..... 346/140 R; 347/9, 347/12, 17, 60, 13, 180, 42; 358/449

[56] References Cited

U.S. PATENT DOCUMENTS

| | | | |
|---|---|---|---|
| 4,568,817 | 2/1986 | Leng et al. | 219/216 |
| 4,738,553 | 4/1988 | Uemura et al. | 400/120 |
| 4,963,884 | 10/1990 | Kiguchi et al. | 346/1.1 |
| 4,980,702 | 12/1990 | Kneezel et al. | 347/17 |
| 5,103,245 | 4/1992 | Yoshida | 346/76 PH |
| 5,109,233 | 4/1992 | Nishikawa | 346/1.1 |
| 5,115,255 | 5/1992 | Kobayashi et al. | 346/76 PH |
| 5,122,882 | 6/1992 | Ishida et al. | 358/296 |
| 5,144,329 | 9/1992 | Takeda et al. | 346/1.1 |
| 5,177,499 | 1/1993 | Yoshida et al. | 346/76 PH |
| 5,184,151 | 2/1993 | Ono et al. | 346/76 PH |
| 5,187,494 | 2/1993 | Ono et al. | 346/76 PH |
| 5,193,007 | 3/1993 | Yokoyama et al. | 358/296 |
| 5,204,692 | 4/1993 | Awai et al. | 346/76 PH |
| 5,206,661 | 4/1993 | Terajima et al. | 346/76 PH |
| 5,220,431 | 6/1993 | Yammagguchi | 358/296 |
| 5,231,421 | 7/1993 | Yoshida et al. | 346/76 PH |
| 5,262,799 | 11/1993 | Ono et al. | 346/76 PH |

FOREIGN PATENT DOCUMENTS

| | | |
|---|---|---|
| 58-211473 | 12/1983 | Japan . |
| 61-078671 | 4/1986 | Japan . |
| 62-003969 | 1/1987 | Japan . |
| 62-094360 | 4/1987 | Japan . |
| 62-135382 | 6/1987 | Japan . |
| 62-164568 | 7/1987 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

Received image data is recorded on a recording material (e.g., thermosensitive paper) by using a full-line recording head on which thermosensitive plural recording elements (e.g., heating elements) corresponding to a maximum recording width are arrayed. At this time, in a stand-by condition, recording elements in the portions corresponding to the appropriate recording material size are preliminarily heated at predetermined time intervals. In a receiving mode, recording elements in the portions corresponding to the appropriate recording size of received image data are preliminarily heated prior to recording received data.

28 Claims, 16 Drawing Sheets

FIG. 12

| HEAD SIZE | RECORDING PAPER SIZE | RECORDING SIZE | LEFT-END WHITE | IMAGE OR PREHEAT | RIGHT-END WHITE |
|---|---|---|---|---|---|
| B4 | B4 | B4 | 0 DOTS | 2048 DOTS | 0 DOTS |
| B4 | B4 | A4 | 160 DOTS | 1728 DOTS | 160 DOTS |
| B4 | A4 | A4 | 160 DOTS | 1728 DOTS | 160 DOTS |
| A4 | A4 | A4 | 0 DOTS | 1728 DOTS | 0 DOTS |

FIG. 13

| HEAD SIZE | RECORDING PAPER SIZE | LEFT-END WHITE | SOLID BLACK | RIGHT-END WHITE |
|---|---|---|---|---|
| B4 | B4 | 0 DOTS | 1728 DOTS | 0 DOTS |
| B4 | A4 | 160 DOTS | 1728 DOTS | 160 DOTS |
| A4 | A5 | 0 DOTS | 1728 DOTS | 0 DOTS |

RECORDING APPARATUS WITH STANDBY CONTROL FOR THERMAL HEAD

BACKGROUND OF THE INVENTION

1. Field of the Invention

The present invention relates to a recording apparatus and method capable of recording images of various recording sizes.

2. Description of the Related Art

A recording apparatus has been proposed in which the recording means operate at times other than during the actual recording time. In a recording apparatus which prints characters or images on thermosensitive paper in response to heat generation by a thermal head, in a standby condition recording energy is applied for predetermined time intervals to all the portions corresponding to the size of recording means (specifically a thermal head). As a result, the thermal head is always maintained above a predetermined temperature to keep the recorded image quality good. In particular, the quality of the first recorded image is improved. Also, a recording apparatus which performs satisfactory recording of one line by applying recording energy to all the portions corresponding to a thermal head size prior to the operation of recording one line has been proposed.

However, the above-described devices have the following drawbacks which occur because recording energy is applied to all the portions corresponding to a thermal head size regardless of a recording paper size, recording size or thermal head size. This drawback will be explained concretely with regard to conventional printing in which recording means operate at times other than the actual recording time, as shown in FIGS. 13 and 14.

As shown in FIG. 14, if recording energy is applied to all the portions corresponding to a thermal head size when the size of a thermal head is B4, the size of a recording paper is B4, and the recording size is A4, recording energy is applied to the leftward and rightward portions {portions (a) and (b)} of the B4 recording paper. Therefore, there is a drawback in that this printing operation is performed on a region larger than the recording area, and therefore applied energy is wasted.

As shown in FIG. 15, if recording energy is applied to all the portions corresponding to a thermal head size when the size of a thermal head is B4, and the size of the recording paper is A4, and the recording size is A4, recording energy is applied to portions (c) and (d) of a platen roller, and so the thermal head damages the roller and wastes the applied energy. A further drawback to this method is that ink is deposited on the platen roller in thermal transfer recording.

SUMMARY OF THE INVENTION

In one embodiment of the present invention, an image recording apparatus is provided for recording an image on a recording medium using recording means that records according to image data, the image data having a recording size. This apparatus includes data size detecting means which detects the recording size of the image data, and control means which drives a portion of the recording means which is associated with the recording size that has been detected by the data size detecting means at times when data is not being recorded.

Another aspect of this invention relates to an image recording method for recording an image on a recording medium using recording means that records the image according to an image data that has a recording size. This method involves the steps of detecting the recording size of the image data, and driving a portion of the recording means associated with the recording size which has been detected at times when data is not being recorded.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

BRIEF DESCRIPTION OF THE DRAWINGS

FIG. 12 shows a specific example showing the relationship between the respective sizes of the head, recording paper and recording, left-end white data, effective information and right-end white data;

FIG. 13 shows another specific example depicting the relationship between the respective sizes of the head, recording paper, left-end white data, effective information and right-end white data;

DETAILED DESCRIPTION OF THE PREFERRED EMBODIMENTS

A preferred embodiment of the present invention will be explained below with reference to the accompanying drawings.

Figure 1:
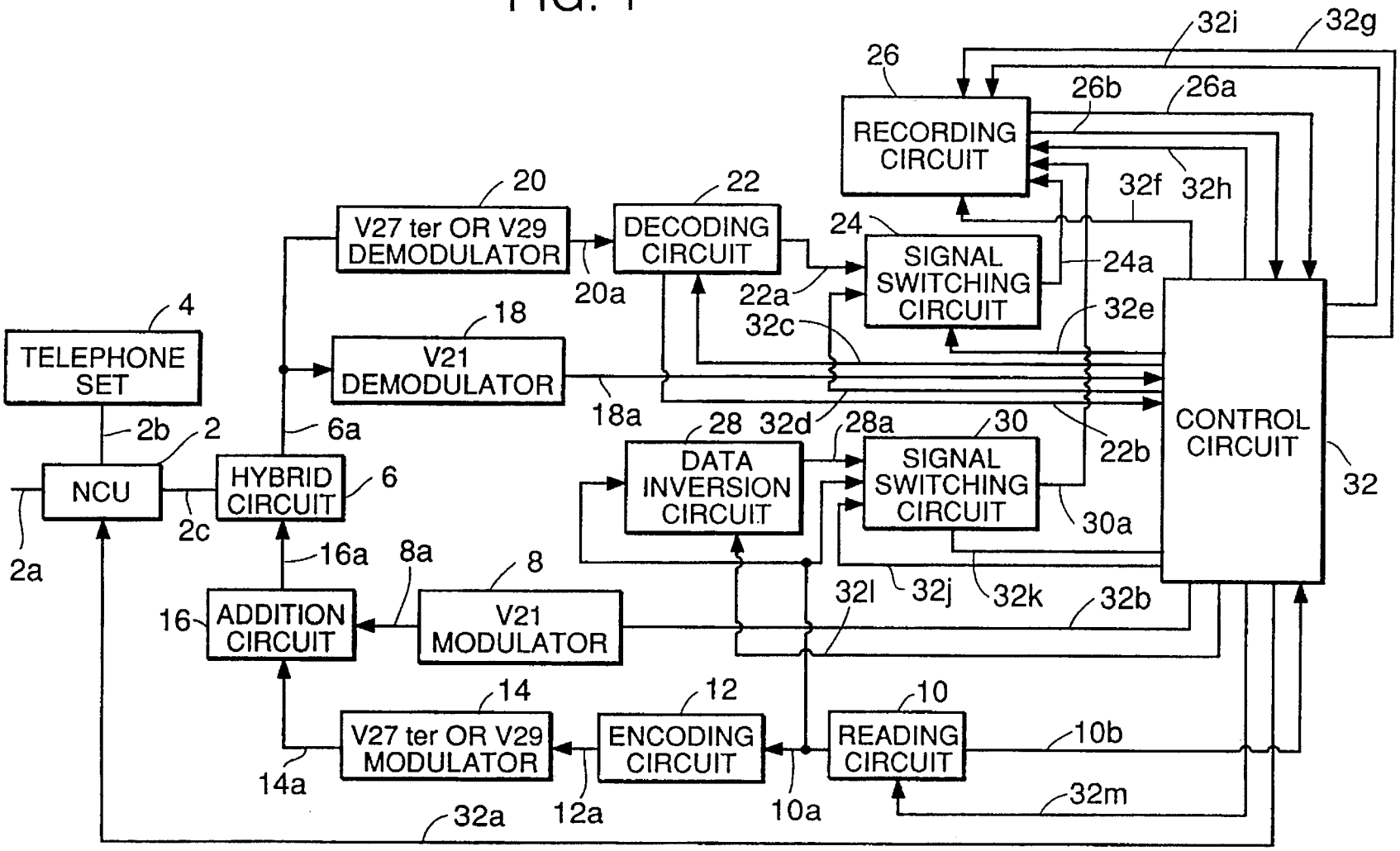
FIG. 1 is a block diagram illustrating the construction of a facsimile apparatus in accordance with an embodiment of the present invention.

FIG. 1 shows a block diagram of the construction of a facsimile apparatus of an embodiment of the present invention.

In FIG. 1, reference numeral 2 denotes a network control unit (NCU), by which a telephone network is connected to terminals of a line used for data communication, for controlling the connection of a telephone exchange network, switching to a data communication path, and maintaining a loop. Signal line 2*a* is a telephone line. Signals from signal line 32*a* are input to the NCU 2. If the level of this signal is "0", the telephone line 2*a* is connected to a telephone set side, i.e., signal line 2*b*. If the level of this signal is "1", the telephone line 2*a* is connected to a facsimile apparatus side, i.e., signal line 2*c*. In the normal condition, the telephone line 2*a* is connected to the telephone set side 2*b*. Reference numeral 4 denotes a telephone set.

Reference numeral 6 denotes a hybrid circuit for separating signals of a transmission system from signals of a receiving system. Transmission signals of signal line 16*a* are sent out to the telephone line 2*a* after the signals are passed through the signal line 2*c* and the NCU 2. Signals received from a corresponding station are passed through the signal line 2*c* via the NCU 2 and output to a signal line 6*a*.

Transmission signals of the signal line 16*a* are generated as described below.

Reference numeral 8 denotes a modulator for performing modulations based on the well-known CCITT recomendation V21. The modulator 8 inputs and modulates procedure signals of a signal line 32*b* and outputs the modulated signals to signal line 8*a*.

Reference numeral 10 denotes a reading circuit which reads image signals from one line in the direction of the main scanning one after another from a transmission original document and creates a sequence of signals indicating binary states of white and black. This reading circuit is formed with image pickup elements such as a CCD (charge-coupled device) and an optical system. When a one-line-of-data output command pulse is generated in signal line 32*m*, read information of 1,728 dots for an A4 size image or read information of 2,048 dots for a B4 size image are output to signal line 10*a* as a sequence of binarized signals of white and black. When the size of the read document is A4, a level "0" signal is output to signal line 10*b*; when the size is B4, a level "1" signal is output to the signal line 10*b*. Reference numeral 12 denotes an encoding circuit which inputs and encodes read data being output to the signal line 10*a* and outputs MH (Modified Huffman) coded or MR (Modified Read) coded data to signal line 12*a*. Reference numeral 14 denotes a modulator for performing modulation based on the well-known CCITT recomendation V27 ter (differential phase modulation) or V29 (orthogonal modulation). This modulator 14 inputs and modulates signals from the signal line 12*a* and outputs the modulated data to signal line 14*a*.

Reference numeral 16 denotes an addition circuit which inputs signals from the signal lines 8*a* and 14*a*, which signals are respectively output from the modulators 8 and 14, and outputs the added result to the signal line 16*a*.

In contrast, signals received through the signal line 6*a* are processed as described below.

Reference numeral 18 denotes a demodulator for performing demodulation based on the well-known CCITT recommendation V21, which inputs signals from the signal line 6*a* and demodulates the signals on the basis of V21 and outputs data to signal line 18*a*.

Reference numeral 20 denotes a demodulator for performing demodulation based on the well-known CCITT recommendation V27 ter (differential phase modulation) or V29 (orthogonal modulation). The demodulator 20 inputs and demodulates signals of the signal line 6*a* and outputs the demodulated signals to signal line 20*a*. Reference numeral 22 denotes a decoding circuit which inputs signals of the signal line 20*a* and stores data of some lines. The decoding circuit 22 outputs a level "1" signal to signal line 22*b* when the decoding circuit 22 does not store at least one line of data and outputs a level "0" signal to signal line 22*b* when the decoding circuit 22 does not store at least one line of data. The decoding circuit 22 outputs MH (Modified Huffman) decoded or MR (Modified Read) decoded data to signal line 22*a* when a one-line-of-data output command pulse is generated in signal line 32*c*. If the size of the document is A4, 1,728 dots of information are output, and if it is B4, 2,048 dots of information are output.

Reference numeral 24 denotes a signal switching circuit. This signal switching circuit 24 receives signals being input on the signal line 22*a* when a level "0" signal is being output to a signal line 32*e* and receives signals being input on signal line 32*d* when a level "1" signal is being output to the signal line 32*d*, and outputs the signals to signal line 24*a*.

Reference numeral 26 denotes a recording circuit which receives signals being input to the signal line 24*a* when a level "0" signal is being output to signal line 32*f*, receives signals being input to the signal line 30*a* when a level "1" signal is being output to the signal line 32*f*, and latches the data when a latch pulse is generated in signal line 32*g*. When the recording operation is performed, recording energy is applied through a signal line 32*h* while recording paper is fed according to a signal through signal line 32*i*. The recording circuit 26 outputs a level "0" signal to signal line 26*a* when the head size corresponds to A4 and outputs a level "1" signal to signal line 26*a* when the head size corresponds to B40 The recording circuit 26 also outputs a level "0" signal to signal line 26*b* when the size of the recording paper is A4 and outputs a level "1" signal to signal line 26*b* when the size of the recording paper is B4.

Reference numeral 28 denotes a data inversion circuit which receives signals being input by the signal line 10*a* and outputs inversion data of storage data to signal line 28*a* when a one-line-of-data output command pulse is generated in signal line 321. Reference numeral 30 denotes a signal switching circuit which receives signals being input by the signal line 10*a* when a "0" signal is being input by signal line 32*k*, receives signals being input by the signal line 28*a* when a "1" signal is being input by the signal line 32*k*, receives signals being input by the signal line 32*j* when a "2" signal is being input by the signal line 32*k*, and outputs the signals to the signal line 30*a*.

Reference numeral 32 denotes a control circuit which primarily performs the control operations described below in accordance with the above-described construction. The control circuit 32 can take the form of a microcomputer having a ROM and a RAM contained therein.

That is, in the stand-by condition, energy is applied to heating elements in the portion of the thermal head corresponding to the appropriate recording paper size every time a predetermined time passes (e.g., one minute) so that the temperature of the thermal head is kept constant. When a communication operation or a copy operation in a binary mode is selected, recording energy is applied to heating elements in the portion of the thermal head corresponding to the appropriate recording size when a predetermined time passes after recording of one line has been terminated, and recording energy (hereinafter referred to as preheat energy)

is applied to heating elements in the portion corresponding to the appropriate recording size immediately before recording the next line. Therefore, the printing quality for each line is improved. When a copy operation in halftone mode is selected, inversion data for the previous line is used as preheat data. It is important that only recording data corresponding to the recording size be inverted and that printing energy is not applied to heating elements in the portion other than that corresponding to the recording size.

Figure 2:
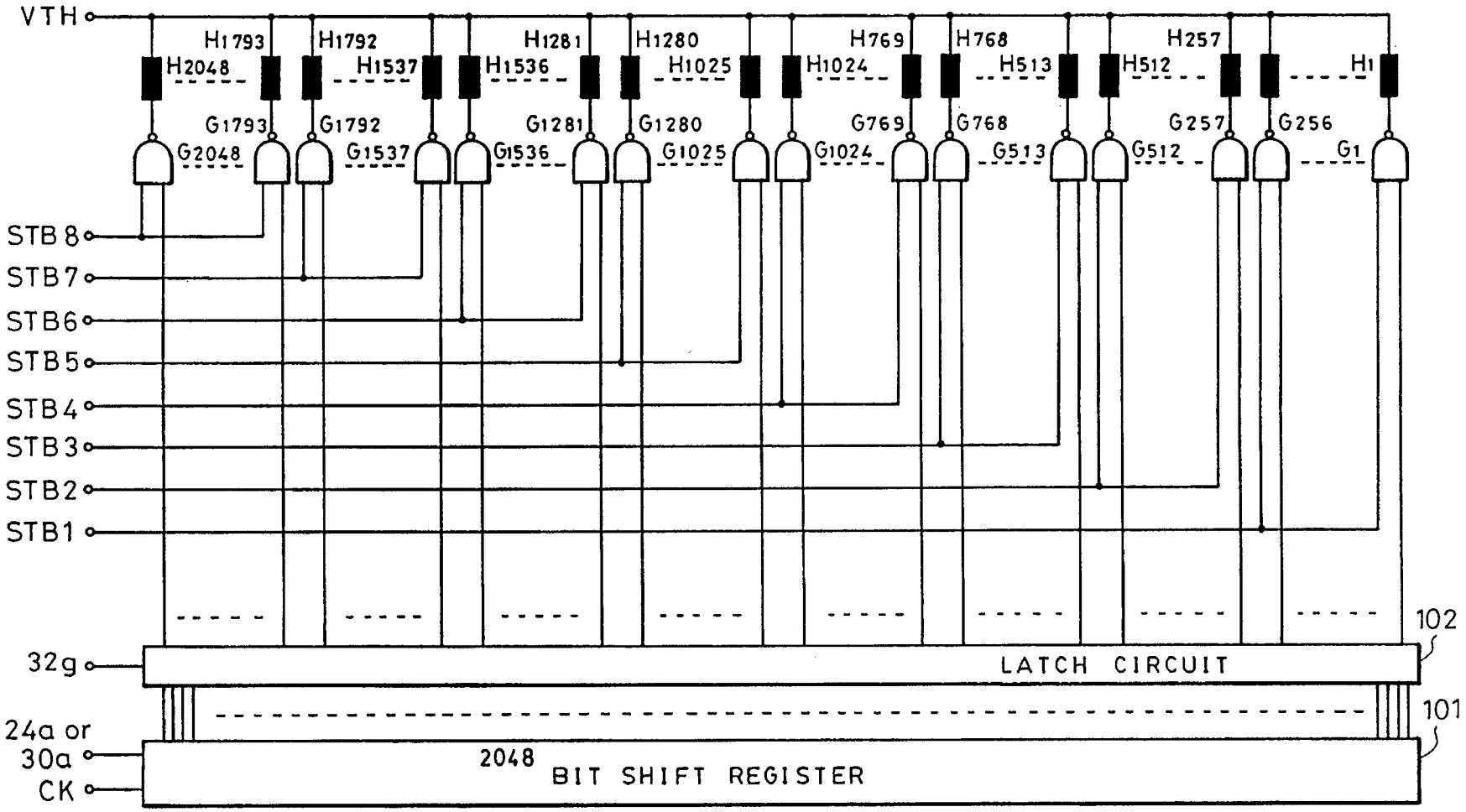
FIG. 2 is a block diagram illustrating the construction of a recording head of the facsimile apparatus.

FIG. 2 is a block diagram illustrating the construction of a recording head in the recording circuit 26. In FIG. 2, reference letters $H_1$ to $H_{2048}$ denote heating elements which generate heat when an electric current is applied thereto. In this embodiment, this is a full-line head having a plurality of heating elements (2,048 in this embodiment) corresponding to a maximum recording width (B4 in this embodiment). Reference letters $G_1$ to $G_{2048}$ denote gates provided corresponding to the heating elements $H_1$ to $H_{2048}$. Reference numeral 101 denotes a shift register of 2,048 bits for storing recording data input from signal line 24*a* or 30*a*. Input recording data is sequentially shifted by a predetermined clock signal Ck. Reference numeral 102 denotes a latch circuit for latching recording data stored in the shift register 101 in response to a latch signal input from signal line 32*g*.

Output signals from the latch circuit 102 are input to one of the input terminals of gates $G_1$ to $G_{2048}$. Strobe signals $STB_1$ to $STB_8$ for driving heating elements $H_1$ to $H_{2048}$ on a time-divided basis are input in response to signals from the signal line 32*h* to the other input terminals of gates $G_1$ to $G_{2048}$. Heating elements $H_1$ to $H_{2048}$ are divided into 8 blocks, each of which consists of 256 elements. The blocks are each driven on a time-divided basis by strobe signals $STB_1$ to $STB_8$.

Figure 3:
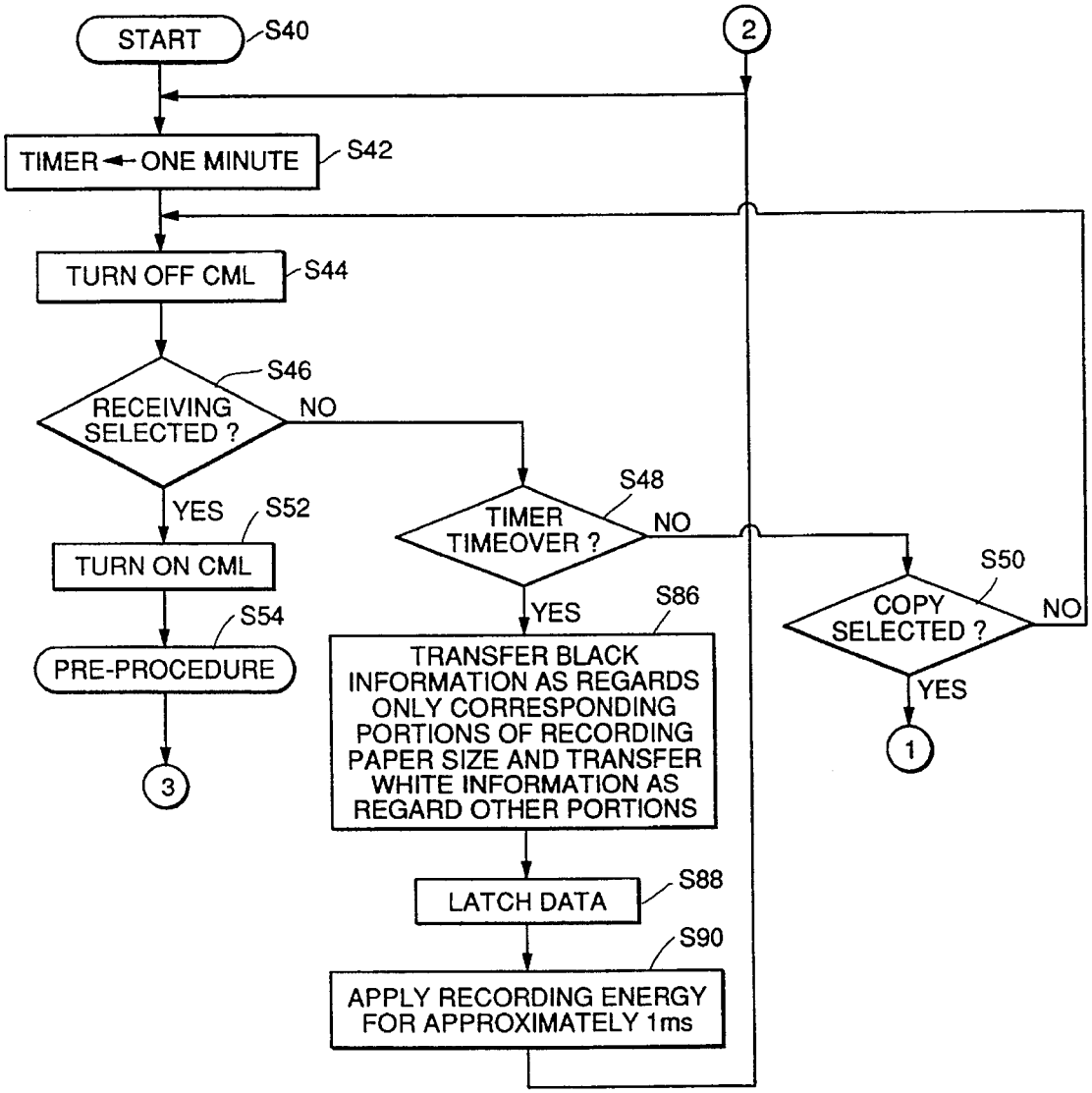
FIG. 3 is a flowchart showing a control sequence of control circuit 32.
Figure 4:
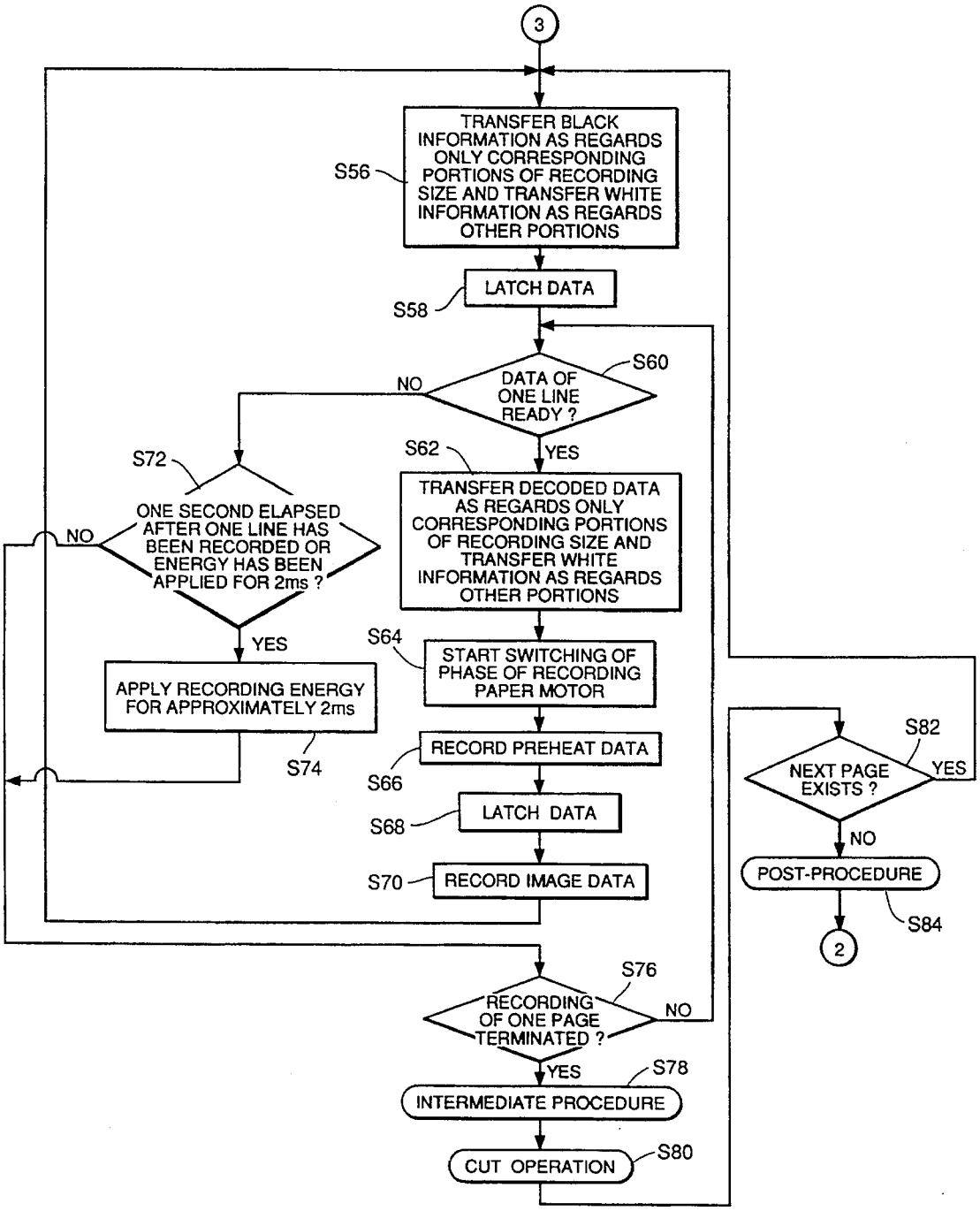
FIG. 4 is a flowchart showing a control sequence of control circuit 32.
Figure 5:
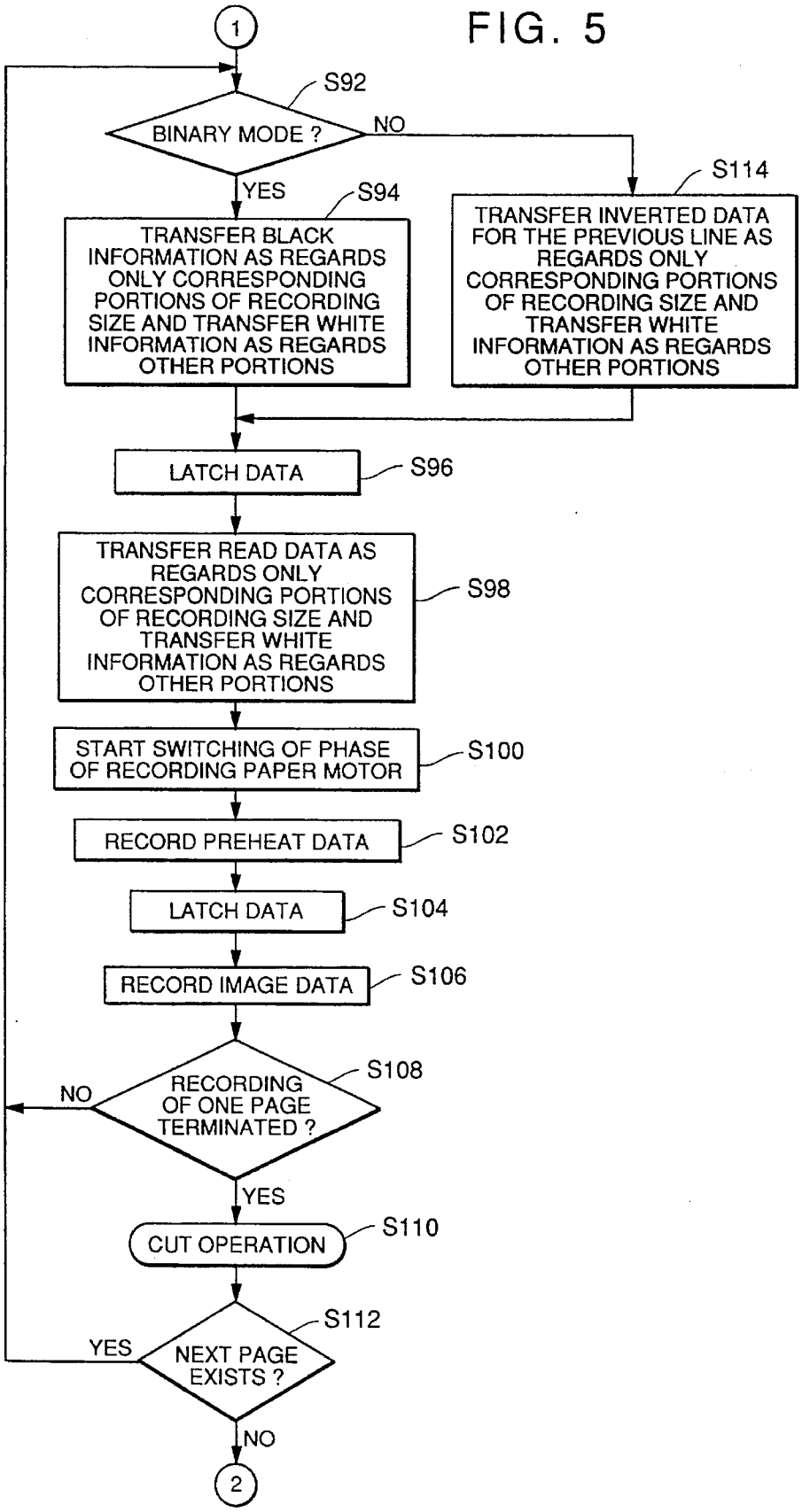
FIG. 5 is a flowchart showing a control sequence of control circuit 32.

FIG. 3 is a flowchart showing a control sequence executed by a microcomputer within the control circuit 32.

In FIG. 3, step S40 indicates the start of the control. In step S42, the timer is set to one minute. In step S44, a level "0" signal is output to the signal line 32*a* to turn off CML (Connect Modem to Line). In step S46, the control circuit 32 determines whether the receiving mode has been selected. When the receiving mode has been selected, the process advances to step S52; when it has not, the process advances to step S48 where a determination is made whether the timer has counted the one minute. If more than one minute has passed, the process proceeds to step S86. If it has not, the process proceeds to step S50 where a determination is made whether a copy mode has been selected. When a copy mode has been selected, the process advances to step S92; when not, the process moves to step S44.

(Receiving mode)

When the receiving mode has been selected in step S46, a level "1" signal is output to the signal line 32*a* in step S52 in order to turn on the CML. In Step S54, a predetermined pre-procedure is performed. In step S56, black information is transferred to the portions corresponding to the appropriate recording size and white information is transferred to the other portions.

Figure 6:
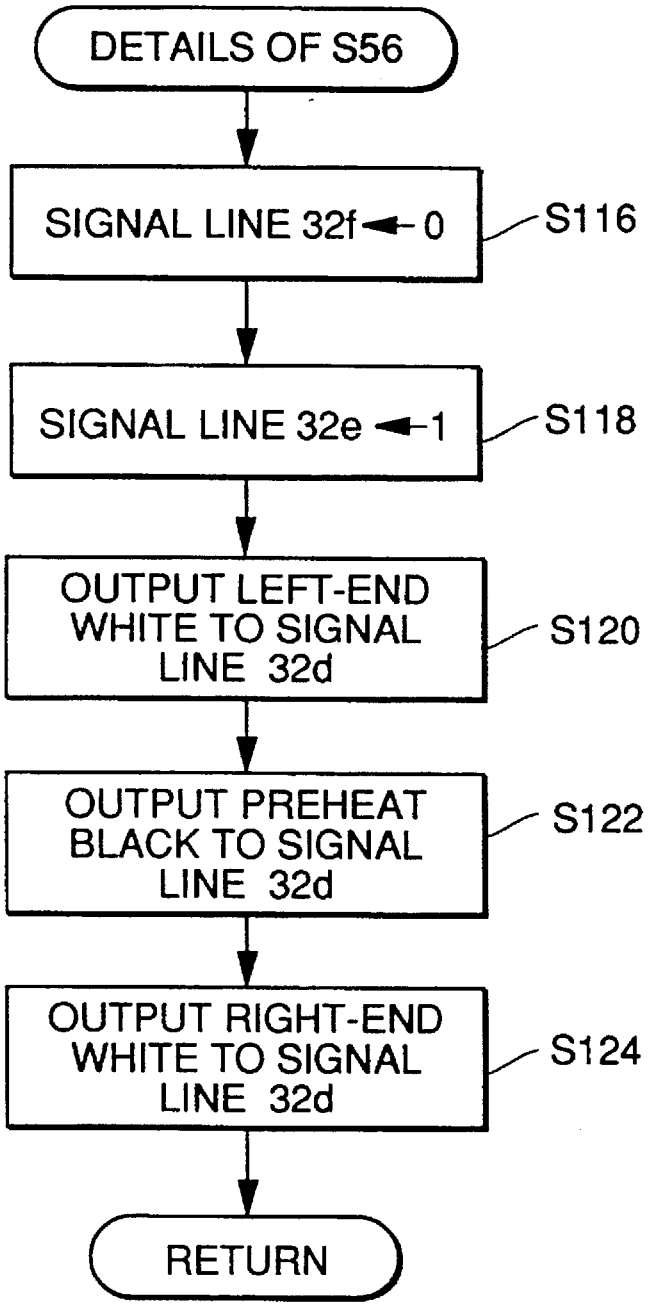
FIG. 6 is a flowchart showing in detail the procedure for step S56 of FIG. 4.

The actual procedure of step S56 is illustrated in steps S116 to S124 of FIG. 6. In step S116, a level "0" signal is output to the signal line 32*f*, and the recording circuit 26 receives data from the signal line 24*a*. In step S118, a level "1" signal is output to the signal line 32*e*, and the signal switching circuit 24 receives data from the signal line 32*d*. In steps S120, S122 and S124, left-end white data, preheat black data and right-end white data, all of which are shown in FIG. 12, are output to the signal line 32*d*. The respective numbers of dots to be transferred regarding the left-end white data, image or preheat data, or right-end white data, corresponding to the recording size and the recording paper size, are stored in the ROM of the control circuit 32.

In step S58, a latch pulse is generated in the signal line 32*g* in order to latch recording information. In step S60, when a signal is received from the signal line 22*b*, a determination is made whether data for one line is ready. When data for one line is ready, the process advances to step S62; if not, the process proceeds to step S72. In step S62, decoded data is transferred to only those portions corresponding to the appropriate recording size, and white information is transferred to the other portions.

Figure 7:
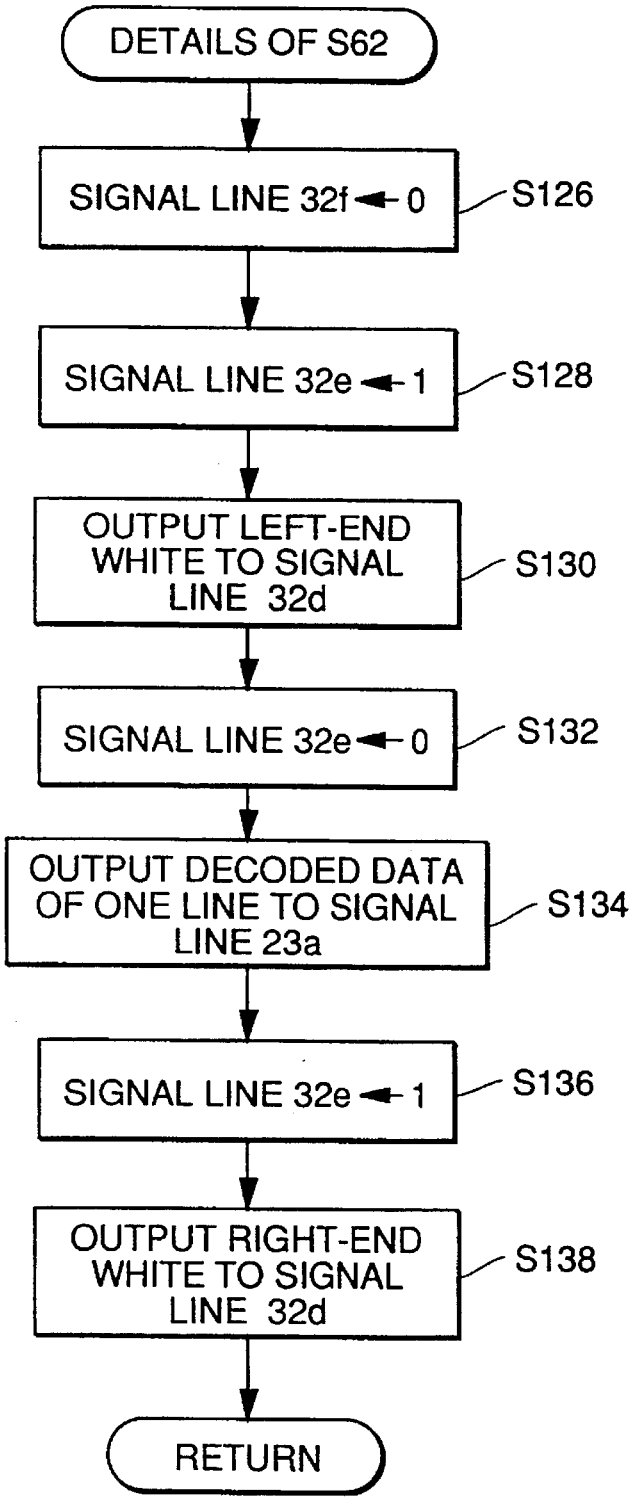
FIG. 7 is a flowchart showing in detail the procedure for step S62 of FIG. 4.

The actual procedure of step S62 is illustrated in steps S126 to S138 of FIG. 7. In this procedure, data shown in FIG. 12 is referenced. Steps S126, S128 and S130 are the same as steps S116, S118 and S120 of FIG. 6, respectively. In step S132, a signal-line level "0" signal is output, and the signal switching circuit 24 receives signals from the signal line 22*a*. In step S134, a one-line-of-data output command pulse is generated in a signal line 32*c* so that decoded data of one line is output to the signal line 22*a*. In step S136, a level "1" signal is output to the signal line 32*e*, and the signal switching circuit 24 receives signals from the signal line 32*d*. In step S138, right-end white data is output to the signal line 32*d*.

In step S64, switching the phase of the recording paper motor begins. In step S66, preheat data is recorded, this data being transferred through the signal line 32*h*. In step S68, a latch pulse is generated in the signal line 32*g* in order to latch data. In step S70, image data is recorded, this data being transferred through the signal line 32*h*, and the process returns to step S56.

If, however, data of one line is not ready in step S60, a determination is made in step S72 whether one second has elapsed after recording of one line has been terminated or after energy has been applied for approximately 2 is (subsequent step S74). If one second has elapsed, energy is applied for recording for approximately 2 is through the signal line 32*h* in step S74. If one second has not elapsed, the process proceeds to step S76 where a determination is made whether recording of one line has terminated. If recording of one line has terminated, a predetermined intermediate procedure (step S78) and a cut operation (step S80) are performed, and the process advances to step S82. If recording of one line has not terminated, the process returns to step S60. In step S82, a determination is made whether the next page is present. If the next page is present, the process returns to step S56; if not, a predetermined post-procedure (step S84) is performed, and the process returns to step S42.

(Stand-by mode)

If a timer set to one minute exceeds that time in step S48, black information is transferred only for those portions corresponding to the appropriate recording paper size, and white information is transferred to the other portions in step S86.

Figure 8:
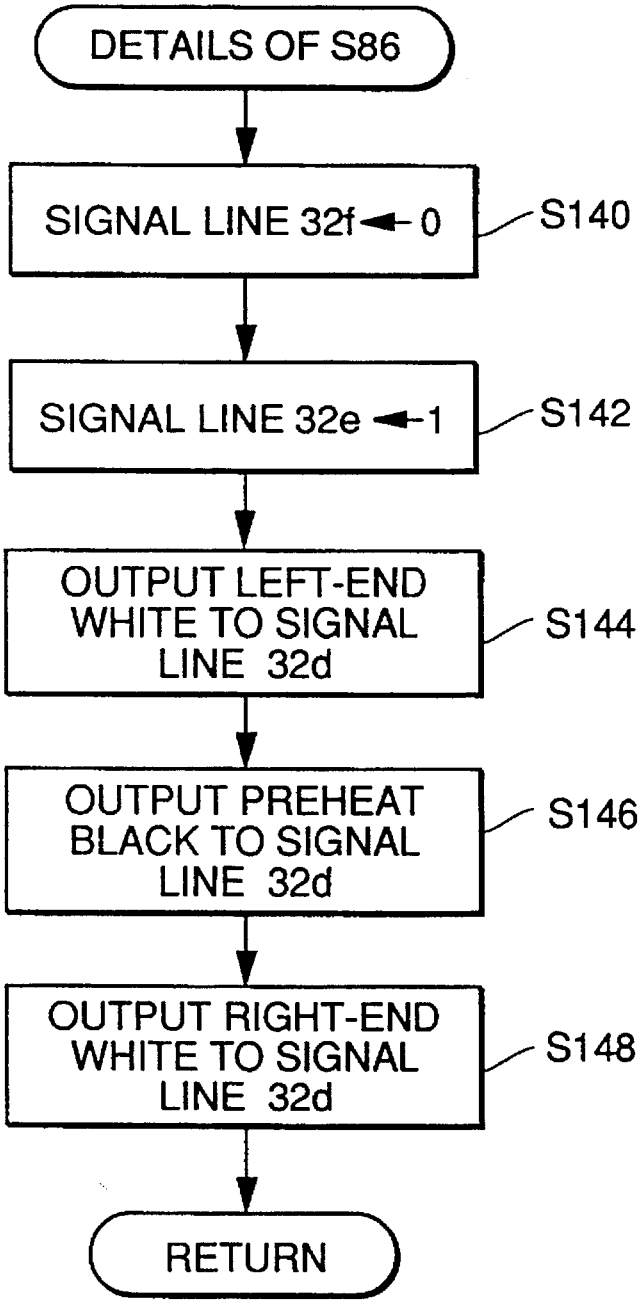
FIG. 8 is a flowchart showing in detail the procedure for step S86 of FIG. 3.

The actual procedure of step S86 is illustrated in steps S140 to S148 of FIG. 8. Steps S140 and S142 are the same as steps S116, S118 and S120 of FIG. 6, respectively. Left-end white data, preheat black data and right-end white data, all of which are shown in FIG. 13, are output to the signal line 32*d* in steps S144, S146 and S148. The respective numbers of dots to be transferred regarding the left-end white data, image or preheat data, or right-end white data, corresponding to the recording size and the recording paper size, are stored in the ROM of the control circuit 32.

In step S88, a latch pulse is generated in the signal line 32*g* in order to latch data. In step S90, recording energy is applied for approximately 1 is through the signal line 32*h*.

(Copy mode)

When a copy mode is selected in step S50, the control circuit 32 determines whether the mode is a binary mode or a halftone mode in step S92. When the mode is a binary mode, the control circuit 32 performs the procedure in step S94; when the mode is a halftone mode, the control circuit 32 performs the procedure in step S114. First, in step S94, black information is transferred for those portions corresponding to the appropriate recording size, and white information is transferred for the other portions.

Figure 9:
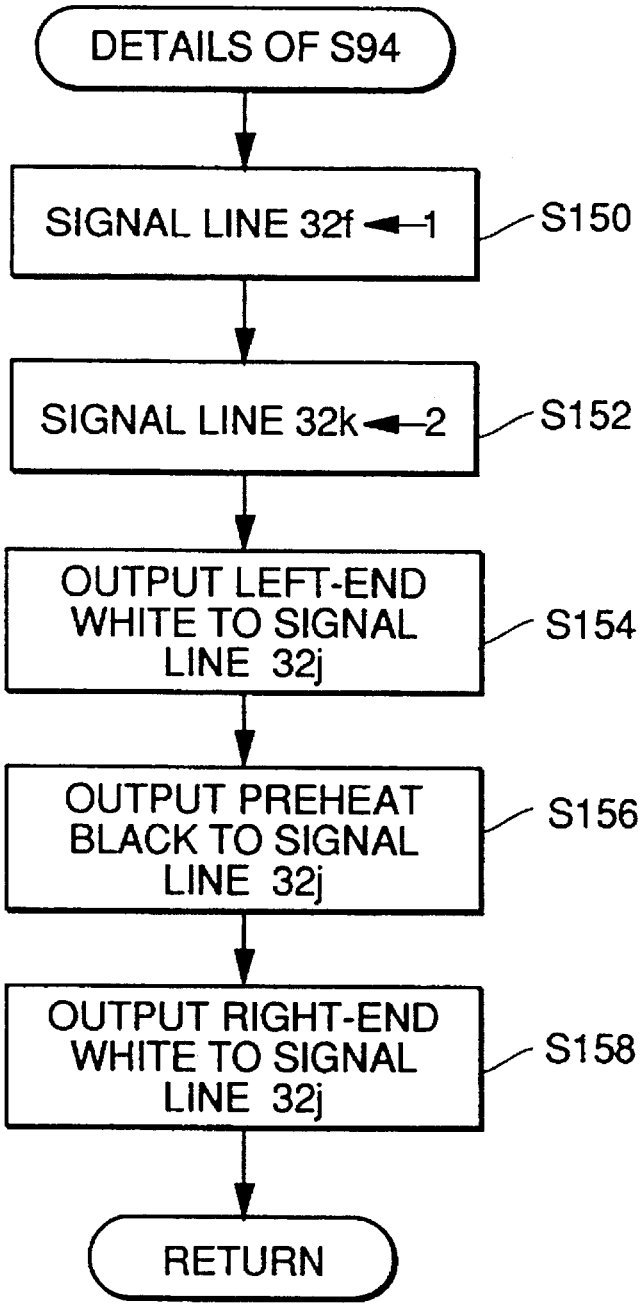
FIG. 9 is a flowchart showing in detail the procedure for step S94 of FIG. 5.

The actual procedure of step S94 is illustrated in steps S150 to S158 of FIG. 9. In this procedure, data of FIG. 12 is referenced. In step S150, a level "1" signal is output to the signal line 32*f*, and the recording circuit 26 receives data from the signal line 30*a*. In step S152, a level "2" signal is output to the signal line 32*k*, and the signal switching circuit 30 receives signals from the signal line 32*j*. In steps S154, S156 and S158, left-end white data, preheat black data and right-end white data, all of which are shown in FIG. 12, are output to the signal line 32*j*.

In step S96, a latch pulse is generated in the signal line 32*g* in order to latch data. In step S98, read data is transferred to only the portions corresponding to the appropriate recording size, and white information is transferred to the other portions.

Figure 10:
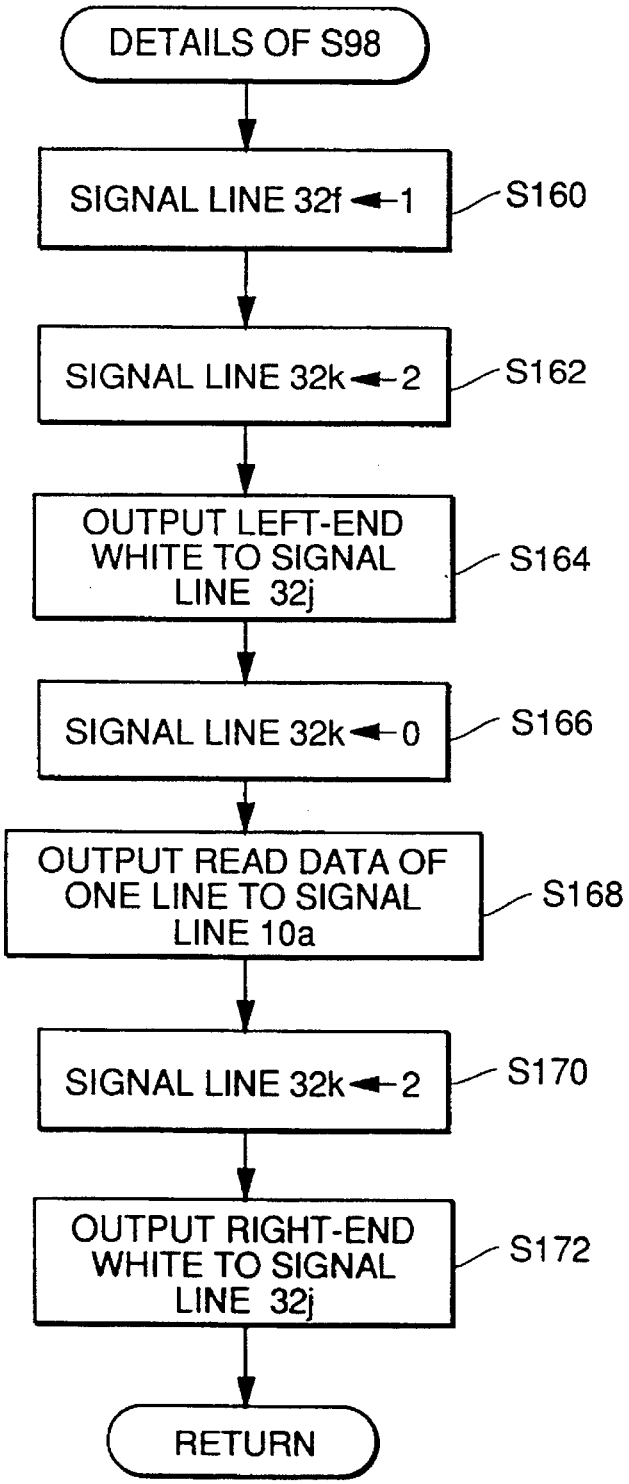
FIG. 10 is a flowchart showing in detail the procedure for step S98 of FIG. 5.

The actual procedure of step S96 is illustrated in steps S160 to S172 of FIG. 10. Steps S160, S162 and S164 are the same as steps S150, S152 and S154 of FIG. 9, respectively. In step S166, a "0" signal is output to the signal line 32*k*, and the signal switching circuit 30 receives signals from the signal line 10*a*. In step S168, a one-line-of-data output command pulse is generated in a signal line 32*m*, and read data of one line is output to the signal line 10*a*. In step S170, a "2" signal is output to the signal line 32*k*, and the signal switching circuit 30 receives signals from the signal line 32*j*. In step S172, left-end white data shown in FIG. 12 is output to the signal line 32*j*.

In step S100, switching the phase of the recording paper motor is started. In step S102, preheat data is recorded, this data being transferred through the signal line 32*h*. In step S104, a latch pulse is generated in the signal line 32*g* in order to latch data. In step S106, image data is recorded, this data being transferred through the signal line 32*h*. In step S108, the control circuit 32 determines whether recording of one line has terminated. If recording of one line has terminated, the control circuit 32 performs the procedure in step S110 where a cut operation is performed. If recording of one line has not terminated, the process returns to step S92. In step S112, the control circuit 32 determines whether the next page is present. If the next page is present, the process returns to step S92, if not, to step S42.

Figure 11:
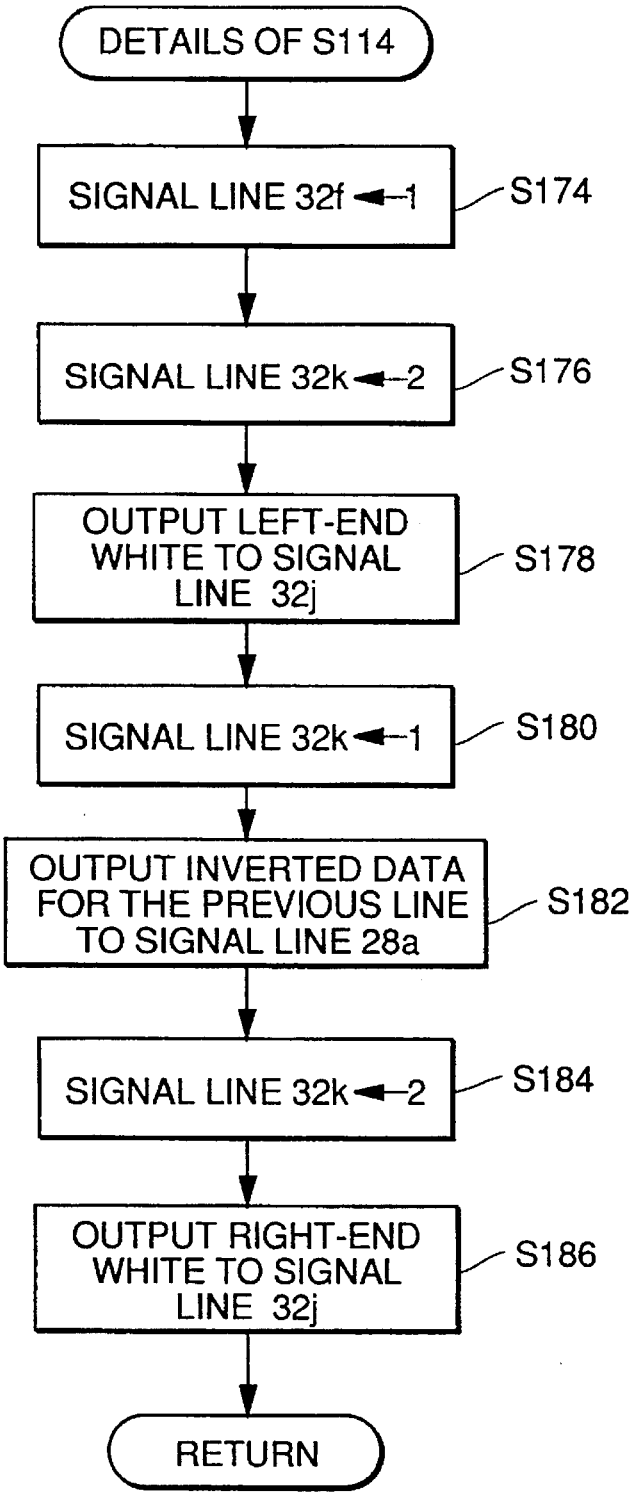
FIG. 11 is a flowchart showing in detail the procedure for step S114 of FIG. 5.
Figure 14:
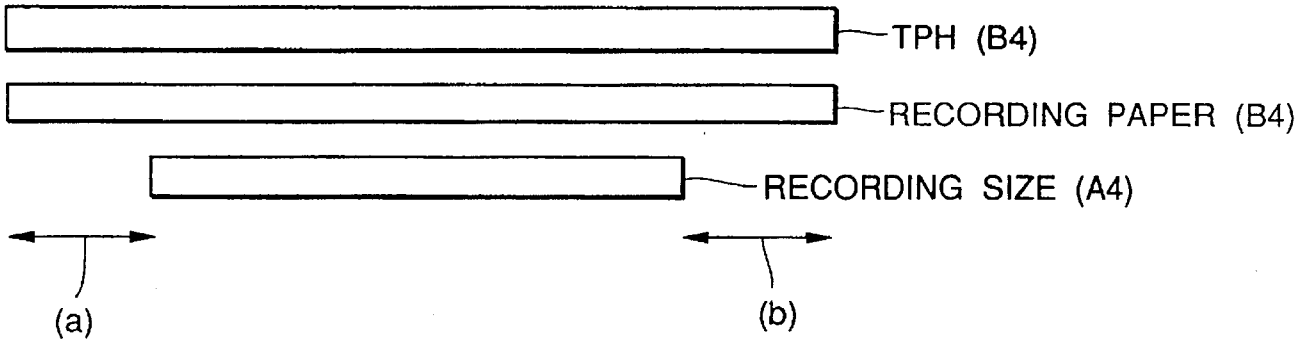
FIG. 14 shows a specific example of the respective sizes of a conventional head, recording paper and recording, and preheating.
Figure 15:
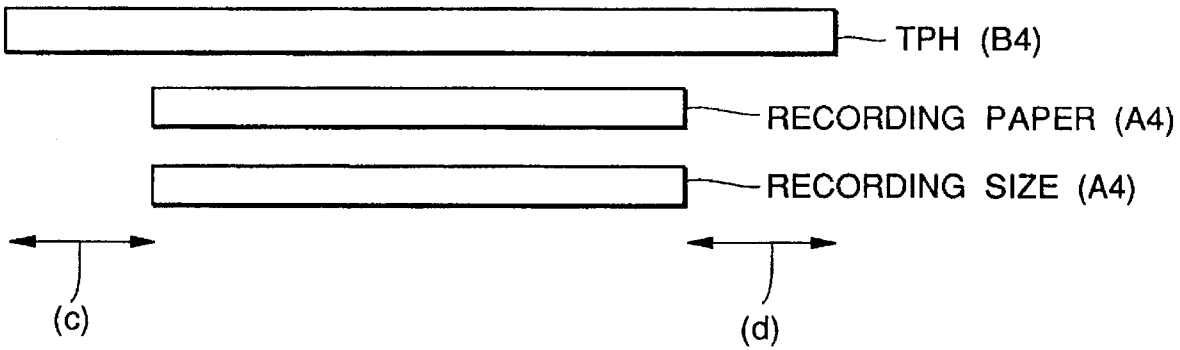
FIG. 15 shows a specific example of the respective sizes of a conventional head, recording paper and recording, and preheating.

In step S114, inverted data for the previous line is transferred to the portions corresponding to the appropriate recording size, and white information is transferred to the other portions. The actual procedure is illustrated from steps S174 to S186 of FIG. 11. Steps S174, S176, S178, S184 and S186 are the same as steps S160, S162, S164, S170 and S172, respectively. In step S180, a "1" signal is output to the signal line 32*k*, and the signal switching circuit 30 accepts signals from the signal line 28*a*. In step S182, a one-line-of-data output command pulse is generated in a signal line 321, so that inverted data for the previous line is sent to the signal line 28*a*.

Since control is performed in the above-described way, undesirable phenomena such as printing outside of recording paper, deposition of ink on the platen roller, deterioration of the thermal head, or applied energy being wasted can be avoided. Further, preheating or application of energy other than recording information for each line is made possible, thus improving the quality of recorded images.

Although a facsimile apparatus has been used as an example in the above-described embodiment, the present invention is not limited to this apparatus, and it may be used in many types of image recording apparatus. Although thermosensitive recording has been described in the above-described embodiment, it is also possible to apply the present invention to other types of recording, such as one-time, or multi-print thermal transfer recording.

In addition, the present invention can be applied to an ink jet recording apparatus of the type in which ink droplets are discharged by using thermal energy to cause the state of ink to change. An example thereof will be explained below.

Figure 16:
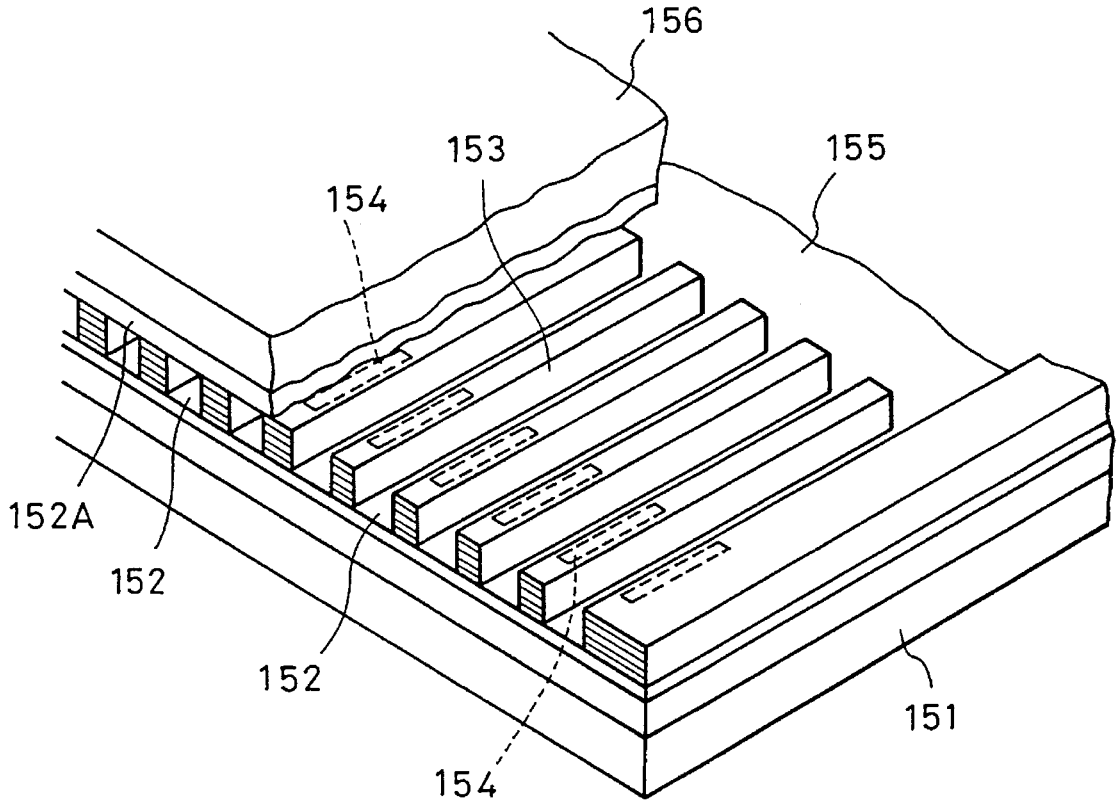
FIG. 16 is a perspective view illustrating the construction of an ink jet recording head.

FIG. 16 is a partial cutaway view of an ink jet recording head to which the present invention can be applied. The recording head is of the so-called full-multi type in which the ejection outlets are aligned across a range corresponding to the entire width of a recording medium.

Reference numeral 154 denotes a heat generating resistor constituting an electro-thermal conversion element (not shown) which generates heat when an electric current is applied thereto, causing film boiling. Consequently, bubbles are generated within the ink, the ink being discharged because of the growth and contraction of the bubbles. The heat generating resistor 154 together with wiring is formed on a substrate 151 through a manufacturing process in the same way as in semiconductors. Reference numeral 152A denotes a liquid-path forming member which forms ejection outlets 152 and liquid paths in communication with these outlets, and which corresponds to the heat generating resistor 154. Reference numeral 156 denotes a top plate which covers the liquid-path forming member. Reference numeral 155 denotes a liquid chamber in communication with the various liquid paths 153, in which ink supplied from an ink supply source (not shown) is stored within the recording head.

Figure 17:
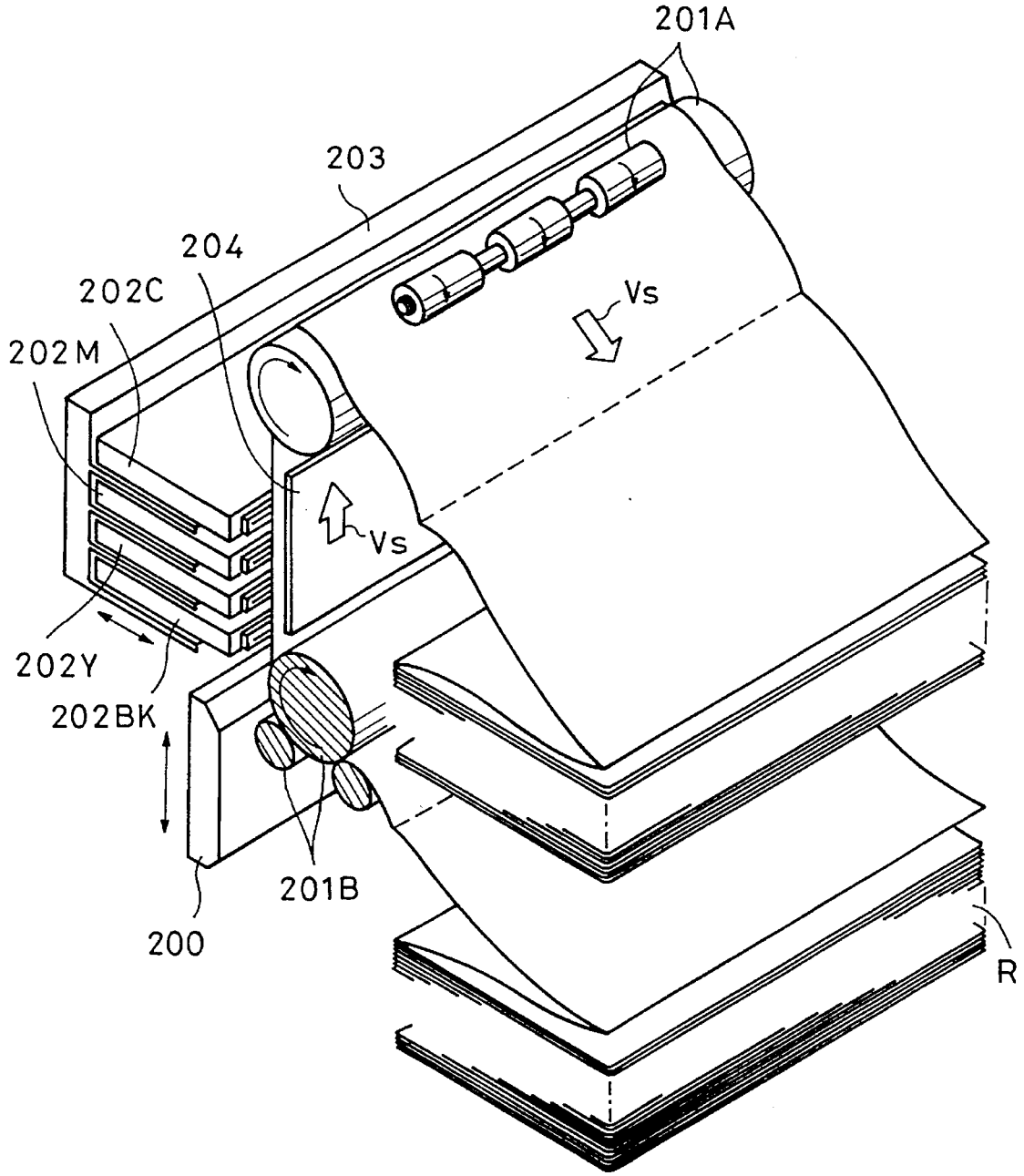
FIG. 17 is a perspective view illustrating the construction of an ink jet recording apparatus.

A line printer having full-color printing capability, for example, as shown in FIG. 17, can be formed by using the above-described recording head and a driving system therefor.

In FIG. 17, reference numerals 201A and 201B respectively denote a pair of rollers having a nip therebetween through which can be fed a recording medium R (e.g., coated paper, plain paper, or plastic sheets) in the sub-scanning direction (indicated by an arrow) Vs. Reference numerals 202BK, 202Y, 202M and 202C denote full-multi type recording heads for performing black, yellow, magenta and cyan recording, respectively, in which nozzles are disposed over the entire width of the recording medium R. The recording heads are disposed in this order in a head mounting portion 203 from the upstream side of the direction in which the recording medium is fed. Reference numeral 200 denotes a recovery system which, in place of the recording medium R, faces the recording heads 202BK to 202C during the ejection recovery operation. That is, the head mounting portion 203 retracts backward, and the recovery system 200 enters the space created by this retracting. Then, a well-known recovery operation, such as suction, is performed. However, in this embodiment, since properly timed preparatory heating is performed, the number of times that the discharge recovery operation need be initiated can be reduced considerably. Reference numeral 204 denotes a platen by which the clearance between the recording medium R and the ejection outlets 152 of the recording head 202 is maintained.

In the aforementioned embodiments, the circuits for the driver IC may be of bi-polar, MOS type, or BiCMOS type or the like, as desired. The recording head is not limited to that of the full-multi-type described above, and for example, it may be of a serial scan type. The method for applying to the electrothermal transducers energy in an amount insufficient to eject the liquid during the preliminary heating is not limited to reducing the pulse width, as in the foregoing embodiment. It may be desirable to change the drive voltage in place of or in addition to changing the pulse width. In any case, the electric power therefore is smaller than the electric power applied to the recording head for the recording operation.

The present invention may be applied to a system comprising a plurality of apparatuses or to an apparatus comprising a single device. Needless to say, the present invention can be achieved by supplying programs to a system or an apparatus.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the claims. The following claims are to be accorded a broad interpretation, so as to encompass all such modifications and equivalent structures and functions.

What is claimed is:

1. An image recording apparatus for recording an image on a recording medium using a recording head which records an image at a predetermined width, said apparatus comprising:

input means for inputting image data;

selection means for selecting a portion of said recording head, when a size of the image data input by said input means is smaller than said predetermined width, in accordance with said size;

recording means for recording the image data on the recording medium using the portion of said recording head selected by said selection means; and control means for controlling temperature of said recording head by supplying energy to the portion of said recording head selected by said selection means when recording of the image data is not performed, wherein said control means does not supply the energy to the other portion of said recording head not selected by said selection means.

2. An image recording apparatus according to claim 1, wherein said recording head is preliminarily driven prior to recording said image data, and said control means supplies energy to said portion of said recording head selected by said selection means during preliminary driving.

3. An image recording apparatus according to claim 1, wherein said control means supplies energy to a portion of said recording head in accordance with a size of said recording medium at predetermined time intervals in a stand-by condition prior to starting recording operation.

4. An image recording apparatus according to one of claims 1 to 3, wherein said recording head has a plurality of recording elements arrayed therein.

5. An image recording apparatus according to claim 4, wherein said recording elements generate heat when an electric current is applied thereto.

6. An image recording apparatus according to claim 5, wherein said recording elements are provided in an amount corresponding to a maximum recording width.

7. An image recording apparatus according to claim 4, wherein said recording elements generate thermal energy, which causes an ink to change state so that said recording head discharges ink droplets from an ejection outlet.

8. An image recording apparatus according to claim 7, wherein said recording elements, an amount of which corresponds to a maximum recording width, are arrayed in said recording head.

9. An image recording apparatus according to claim 2, wherein said control means supplies energy to a portion of said recording head in accordance with a size of said recording medium, at predetermined time intervals in a stand-by condition prior to starting recording operation of said image data.

10. An image recording apparatus according to claim 9, wherein said recording head has a plurality of recording elements arrayed therein.

11. An image recording apparatus according to claim 10, wherein said recording elements generate heat when an electric current is applied thereto.

12. An image recording apparatus according to claim 11, wherein said recording elements are provided in an amount corresponding to a maximum recording width.

13. An image recording apparatus according to claim 10, wherein said recording elements generate thermal energy, which causes an ink to change state so that said recording head discharges ink droplets from an ejection outlet.

14. An image recording apparatus according to claim 13, wherein said recording elements, an amount of which corresponds to the maximum recording width, are arrayed in said recording head.

15. An image recording method for recording an image on a recording medium using a recording head which records an image at a predetermined recording width, said method comprising the steps of:

inputting image data;

selecting a portion of said recording head, when a size of the image data is smaller than said predetermined width, in accordance with said size;

recording the image data using the portion of said recording head selected in accordance with said size; and controlling temperature of said recording head by supplying energy to the portion of said recording head selected in accordance with said size when recording of the image data is not performed, wherein the energy is not supplied to the other portion of said recording head not selected in accordance with said size.

16. An image recording method according to claim 15, wherein said recording head is preliminarily driven prior to recording said image data, and said control means supplies energy to said portion of said recording head selected by said selection means during said preliminary driving.

17. An image recording method according to claim 15, wherein said control means supplies energy to a portion of said recording head in accordance with a size of said recording medium at predetermined time intervals in a stand-by condition prior to starting recording operation.

18. An image recording method according to one of claims 15 to 17, wherein said recording head has a plurality of recording elements arrayed therein.

19. An image recording method according to claim 18, wherein said recording elements generate heat when an electric current is applied thereto.

20. An image recording method according to claim 19, wherein said recording elements are provided in an amount corresponding to a maximum recording width.

21. An image recording method according to claim 18, wherein said recording elements generate thermal energy, which causes an ink to change state so that said recording head discharges ink droplets from an ejection outlet.

22. An image recording method according to claim 21, wherein said recording elements, an amount of which corresponds to a maximum recording width, are arrayed in said recording head.

23. An image recording method according to claim 16, wherein said control means supplies energy to a portion of said recording head in accordance with a size of said recording medium at predetermined time intervals in a stand-by condition prior to starting recording operation of image data.

24. An image recording method according to one of claim 23, wherein said recording head has a plurality of recording elements arrayed therein.

25. An image recording method according to claim 24, wherein said recording elements generate heat when an electric current is applied thereto.

26. An image recording method according to claim 25, wherein said recording elements are provided in an amount corresponding to a maximum recording width.

27. An image recording method according to claim 24, wherein said recording elements generate thermal energy, which causes an ink to change state so that said recording head discharges ink droplets from an ejection outlet.

28. An image recording method according to claim 27, wherein said recording elements, an amount of which corresponds to a maximum recording width, are arrayed in said recording head.

* * * * *

UNITED STATES PATENT AND TRADEMARK OFFICE

CERTIFICATE OF CORRECTION

PATENT NO. : 5,598,190

DATED : January 28, 1997

INVENTOR : TAKEHIRO YOSHIDA

It is certified that error appears in the above-identified patent and that said Letters Patent is hereby corrected as shown below:

COLUMN 4

Line 35, "B40" should read "B4.--.

COLUMN 6

Line 37, "is" should read --ms--;
Line 39, "is" should read --ms--.

COLUMN 7

Line 3, "is" should read --ms--.

UNITED STATES PATENT AND TRADEMARK OFFICE

CERTIFICATE OF CORRECTION

PATENT NO. : 5,598,190

DATED : January 28, 1997

INVENTOR : TAKEHIRO YOSHIDA

It is certified that error appears in the above-identified patent and that said Letters Patent is hereby corrected as shown below:

COLUMN 9

Line 52, "the other" should read --another--.

COLUMN 10

Line 52, "the other" should read --another--.

Signed and Sealed this

First Day of July, 1997

Bruce Lehman

*Attest:*

BRUCE LEHMAN

*Attesting Officer*

*Commissioner of Patents and Trademarks*